US005263837A

United States Patent [19]

Dompe

[11] Patent Number: 5,263,837

[45] Date of Patent: Nov. 23, 1993

[54] PERSONAL UMBRELLA SUPPORT

[76] Inventor: Olman Dompe, 860 ½ Taft Pl., New Orleans, La. 70119

[21] Appl. No.: 802,535

[22] Filed: Dec. 5, 1991

[51] Int. Cl.[5] ..... A45B 11/02

[52] U.S. Cl. ..... 224/190; 224/915

[58] Field of Search ..... 224/186, 187, 188, 189, 224/190, 915, 209; 135/16, 98, 15.1; 248/539, 535, 540

[56] References Cited

U.S. PATENT DOCUMENTS

| | | | |
|---|---|---|---|
| 616,903 | 1/1899 | Crocker | 224/187 X |
| 753,107 | 2/1904 | Pinchback | 224/187 |
| 877,802 | 1/1908 | Shuster | 224/188 |
| 903,682 | 11/1908 | Cumpston | 224/190 |
| 1,066,205 | 7/1913 | Henry | 224/188 |
| 1,205,917 | 11/1916 | Merrill | 224/190 |
| 1,262,402 | 4/1918 | Stuckey | 224/190 |
| 1,347,540 | 7/1920 | Godard | 224/190 |
| 1,466,715 | 9/1923 | Hart | 224/188 |
| 1,704,407 | 3/1929 | Rice | 224/190 |
| 2,926,826 | 3/1960 | Conrad | 224/915 X |
| 3,120,332 | 2/1964 | White | 224/189 |
| 3,263,878 | 8/1966 | Pratt | 224/188 |
| 3,980,216 | 9/1976 | Nye | 224/209 |
| 4,327,852 | 5/1982 | Gibson | 224/209 X |

FOREIGN PATENT DOCUMENTS

| | | | |
|---|---|---|---|
| 56947 | 11/1911 | Switzerland | 224/190 |
| 211395 | 9/1940 | Switzerland | 224/186 |

*Primary Examiner*—Henry J. Recla
*Assistant Examiner*—Glenn T. Barrett
*Attorney, Agent, or Firm*—John F. Sieberth

[57] ABSTRACT

A device is described that is to be worn by the user of an umbrella or parasol. The device supports the umbrella in position over the user so that neither hand is occupied by the umbrella. The device comprises: a) a plate that fits against the user's back; b) a harness connected/connectable to the plate and constructed so as to support the plate against a middle portion of the user's back; and c) a cup or similar support fastened onto the plate to support the umbrella in open position above the user.

15 Claims, 3 Drawing Sheets

PERSONAL UMBRELLA SUPPORT

TECHNICAL FIELD

This invention relates to a device to be worn by the user of an umbrella or parasol (hereinafter collectively referred to as "umbrella") which supports the umbrella in position over the user so that neither hand is occupied by the umbrella. In short, this invention provides a "no hands" umbrella system.

BACKGROUND

As is well known, an umbrella is a portable shade, screen, or canopy which opens and folds, and is carried in the hand as a shelter from the sun or rain. An umbrella is usually made of cloth or fabric extended on a folding radial frame of bars or strips suitably fastened to an axial rod, the opposite end of which terminates in a handle.

When using the umbrella it is commonplace to hold the open device by means of the handle in position such that the extended canopy is suitably disposed above the head of the user. This means that at least one hand of the user is occupied. In many situations such as during shopping, it would be desirable while using the umbrella as a shelter against the sun or rain to have both hands free for other purposes. It would also be desirable to enable an umbrella to be used by persons handicapped by loss of one or both arms or hands.

This invention is deemed to fulfill these needs most efficiently and effectively.

SUMMARY OF THE INVENTION

According to this invention there is provided, inter alia, a device for supporting and maintaining an open umbrella in position above a user of the umbrella which device comprises:

a) a plate sized and adapted to fit against the back of said user;

b) a harness connected/connectable to said plate and adapted to support said plate against a middle portion of the back of said user;

c) fastening means disposed/disposable on said plate and adapted to support said umbrella in open position above said user so that said user need not hold said umbrella in either hand.

Various preferred constructions can be employed in accordance with this invention. For example, the harness can be constructed so that its size is adjustable to enable the device to be worn and used by variously sized persons. Alternatively the harness may be provided in various fixed sizes adapted to suitably fit persons of individual given sizes. In this case, by providing differently sized harnesses that are detachably attachable to the plate, the basic device can be used by differently sized persons simply by selecting and/or interchanging the harness for a proper fit. And, if desired, the devices in their entirety may be provided in a variety of fixed sizes so that, in effect, the device is customized for one or more particular users of a given stature.

In one preferred embodiment, the harness (element b) above) comprises a pair of straps, at least two spaced-apart portions of each such strap being connected/connectable to the plate to form a loop, one of the loop being adapted to fit over the left shoulder and under the left arm of the user, and the other of the loops being adapted to fit over the right shoulder and under the right arm of the user. In this embodiment the straps are connectable to each other across the chest of the user. A particularly preferred form of this type of harness is one in which each of these straps is connected to the plate at two spaced apart locations to form the loop, one portion of the strap being connected to an upper portion of the plate and a different portion of the strap being connected to a lower portion of the plate so that the loop formed by said strap is adapted to extend upwardly and downwardly over a shoulder and laterally around the rib cage area below an arm of the user, these straps optionally being equipped with means for adjusting the size of its respective loop, and at least one of the straps—and preferably both such straps—having affixed thereto a frontal strap member, the frontal strap member(s) (i) being disposed to extend between the loops across the chest of the user when the harness is worn by the user, and (ii) including means for establishing a detachable connection to secure the harness in position on the upper torso of the user.

In another preferred embodiment, the fastening means (element c) above) of the device of this invention are characterized by enabling the axis of the supported umbrella to be adjusted to selected angles of inclination. Pursuant to a still further preferred embodiment, the fastening means (element c) above) comprise a cup or clamp for receiving and supporting the lower portion of the umbrella handle, and at least one clamp for grasping and supporting (i) an upper portion of that handle or (ii) a lower portion of the axial rod of the umbrella at a locus slightly above the upper end of that handle. In yet another preferred embodiment which is particularly useful with umbrellas having straight handles rather than hook-shaped handles, the fastening means (element c) above) comprise a tube adapted to snugly encase at least a substantial portion of the handle of the umbrella, a cup or clamp for receiving and supporting the lower portion of the tube, and at least one clamp for grasping and supporting (i) an upper portion of that handle, or (ii) an upper portion of that tube, or (iii) a lower portion of the axial rod of the umbrella at a locus slightly above (1) the upper end of that handle or (2) the upper end of that tube, whichever of (1) and (2) is higher. In this embodiment, if the tube is open at both ends, it is preferable to employ a cup or like member to support the lower portion of the tube so that the bottom of the handle has an underlying support. On the other hand, if the tube is closed at the bottom end then the lower portion of the tube can be supported by a clamp, although even here use of a cup for this purpose is preferred. It will be appreciated that throughout this disclosure the terms "lower" and "upper" and "bottom" refer to portions of the umbrella handle (or tube encasing the umbrella handle) when the umbrella is in an upright position with the canopy at the top and the handle at the bottom—i.e., in the normal position in which an umbrella is used.

In especially preferred embodiments, the fastening means (element c) above) of the device of this invention comprise:

(1) supporting means (e.g., a cup, clamp or other support mechanism) for supporting the umbrella in the vicinity of its handle when the umbrella is in its upright use position;

(2) rotary means (e.g., a ball and socket joint, pivot or other connection enabling rotary motion within limits in at least one plane and more preferably in all directions), the rotary means being connected directly or indirectly to the supporting means such that the supporting means, and thus the umbrella supported thereby, can be tilted in at least one plane and preferably in any direction within the limits allowed by the rotary means; and (3) restraining means (e.g., an extendable or adjustable clamping mechanism for inhibiting rotary motion of the supported umbrella, and thus the rotary means, once the umbrella has been tilted to its desired position.

The supporting means is/are thus spaced rearwardly from the back of the plate (element a) above) by a distance sufficient to permit such tilting to be accomplished, the "back" of the plate being the area of the plate facing in the same direction as the user's back. If the rotary means permit rotary motion in only one plane, such motion is preferably in the plane bisecting the left and right sides of the user's body so that the umbrella can be tilted forwardly or rearwardly, and then maintained in the position so selected. More preferably however, the rotary means will permit rotary motion in any direction so that the umbrella can be titled, supported and maintained in any direction as needed.

These and other embodiments of this invention will be still further apparent from the ensuing description, accompanying drawings and appended claims.

THE DRAWINGS

In the drawings, wherein like numerals represent like parts:

FURTHER DESCRIPTION OF THE INVENTION

Figure 1:
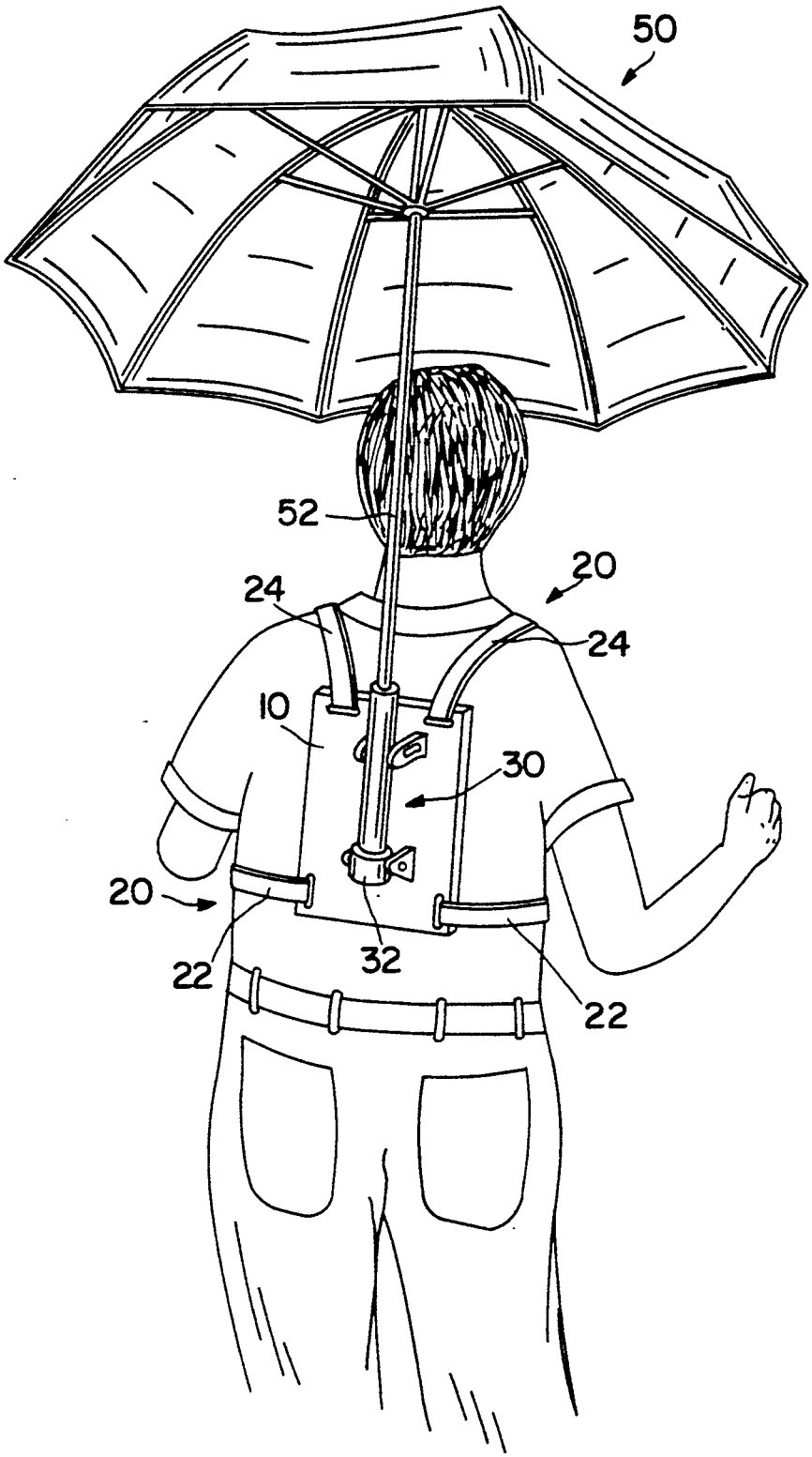
FIG. 1 is a rear view of a person wearing a device of this invention.
Figure 2:
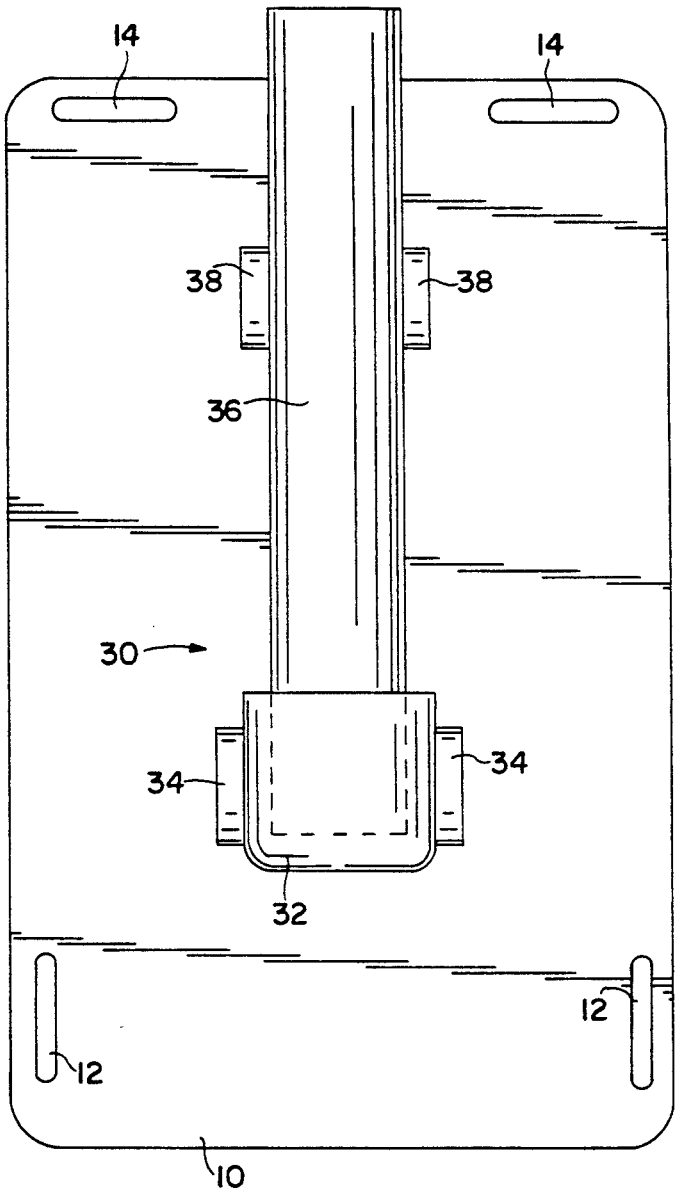
FIG. 2 is a rear elevation of a preferred device of this invention.

Referring to the drawings, the device in the form depicted includes plate 10 sized and adapted to fit against the back of the user, harness 20 connected or connectable to plate 10 and adapted to support plate 10 against a middle portion of the back of the user, and fastening means 30 disposed or disposable on plate 10 and adapted to support umbrella 50 in open position above the user. From FIG. 1 it can be seen that the user need not hold umbrella 50 in either hand.

Figure 3:
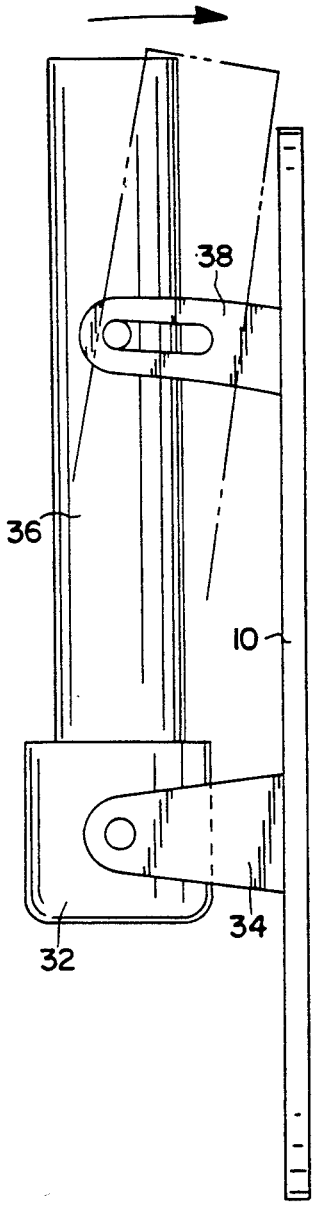
FIG. 3 is a side elevation of a preferred device of this invention.

In the form depicted, fastening means 30 includes cup 32 pivotally supported and secured to plate 10 by means of a pair of brackets 34 extending rearward from plate 10. For best results, the combination of cup 32 and brackets 34 should be positioned between about ¼ to ½ (and more preferably about ⅓) the distance upwardly from the bottom of plate 10 and equidistantly from the sides thereof (as shown). Cup 32 is sized to receive sleeve or tube 36 into which the handle (not shown) of umbrella 50 fits. As shown by FIG. 3, cup 32 and tube 36 can be pivoted forwardly and rearwardly to adjust the upward inclination of umbrella 50. Clamp 38 equipped with wing nuts (not shown) is used to secure tube 36 in the desired position. Alternatively clamp 38 is a spring clamp having rearwardly extending undulating fingers to grasp and hold either tube 36 or stem 52 of the umbrella in any of a plurality of desired positions.

Harness 20 in the form depicted includes horizontal straps 22, 22 that either fit through lower slots 12, 12 in plate 10 (and thus are composed of a single continuous strap) or are each looped through their respective proximate lower slot 12 and connected (as by stitching) or connectable (as by means of snaps) so that they are detachably or permanently attached to plate 10. However attached to plate 10, these straps are disposed so as to extend around the sides of the user's chest and can be secured together at the front of the user's chest as by a buckle or snaps or any other suitable fastener. Shoulder straps 24, 24 either fit through upper slots 14, 14 in plate 10 (and thus are composed of a single continuous strap) or are each looped through their respective proximate upper slot 14 and connected (as by stitching) or connectable (as by means of snaps) so that they are detachably or permanently attached to plate 10. However attached to plate 10, these straps are disposed so as to extend over the user's shoulders and extend down to the generally horizontal loop defined by the horizontal straps 22, 22 to which the shoulder straps are connected the front of the user's chest as by buckles or snaps or any other suitable fastener (if a detachable connection is desired) or by stitching. Shoulder straps 24, 24 thus form a pair of generally vertical loops that fit over the user's shoulders and downwardly over a portion of the user's upper chest.

Figure 4:
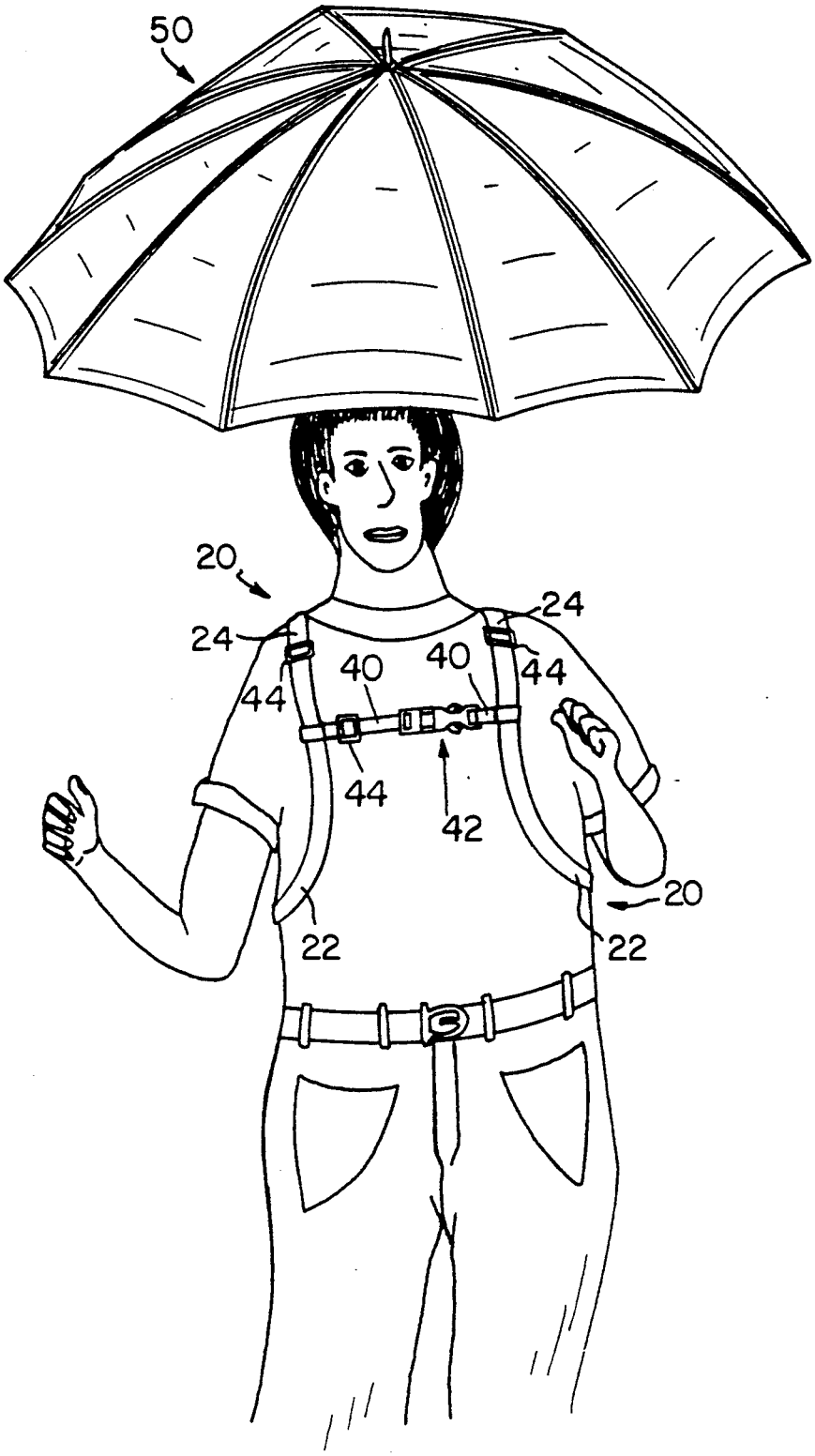
FIG. 4 is a front view of a person wearing a device of this invention.

FIG. 4 shows a pair of individual frontal strap members 40, 40, one affixed to one shoulder strap 24 and the other affixed to the other shoulder strap 24 such that the frontal strap members 40, 40 extend toward each other across the front of the chest of the user. Connector means 42 detachably connect strap members 40, 40 together. Means for adjusting the size of harness 20 are shown at 44.

This invention is susceptible to considerable variation in its practice. Thus this invention is not intended to be limited by the specific exemplifications set forth hereinabove. Rather, the subject matter covered is within the spirit and scope of the appended claims and the permissible equivalents thereof.

I claim:

1. A device for supporting and maintaining an open umbrella in position above a user of the umbrella and where the umbrella has a handle, said device comprising:

a) a plate sized and adapted to fit against the back of said user;

b) a harness connected to said plate and adapted to support said plate against a middle portion of the back of said user, said harness comprising (i) at least one shoulder strap connected to said plate so as to form a spaced-apart pair of separate loops, one said loop being disposed and adapted to extend upwardly and downwardly over the left shoulder and laterally around the rib cage area below the left arm of the user, and the other said loop being disposed and adapted to extend upwardly and downwardly over the right shoulder and laterally around the rib cage area below the aright arm of the user; (ii) a pair of individual frontal strap members, one of said frontal strap members being affixed to one of said loops, and the other of said frontal strap members being affixed to the other of said loops such that said frontal strap members are disposed and adapted to extend toward each other across the front of the chest of the user when the harness is worn by the user, and (iii) connector means for detachably connecting said frontal strap members together across the front of the chest of the user to thereby secure the harness in position on the upper torso of the user; and c) umbrella supporting means adapted to support an umbrella in open position above the user so that the user need not hold said umbrella in either hand, said umbrella supporting means comprising (i) a pair of brackets attached to and extending rearwardly from said plate; (ii) a cup-shaped support member having an open end and a closed end, said cup-shaped support member being adapted to provide support to the handle of the umbrella and being pivotally supported between said pair of brackets such that said cup-shaped support member is rearwardly spaced from said plate with said open end facing upwardly and said closed end facing downwardly whereby said cup-shaped support member can be pivotally tilted to selected forwardly inclined angles of inclination; and a tube at least a portion of which is sized to fit into said cup-shaped support member, said tube being adapted snugly encase at least a substantial portion of the handle of an umbrella when supported by said cup-shaped support member.

2. A device in accordance with claim 1 wherein said harness is adjustable in size to enable said harness to fit various sized persons.

3. A device in accordance with claim 1 wherein said harness has a pair of said shoulder straps, wherein one of said pair of shoulder straps is connected to said plate at two spaced-apart locations so as to form one of said spaced-apart pair of separate loops, and wherein the other of said pair of shoulder straps is connected to said plate at two other spaced-apart locations so as to form the other of said spaced-apart pair of separate loops.

4. A device in accordance with claim 3 wherein each of said shoulder straps is equipped with adjusting means for adjusting the size of its respective loop.

5. A device in accordance with claim 1 wherein said umbrella supporting means further comprise at least one clamp means attached to and extending rearwardly from said plate, said clamp means being disposed above and in vertical alignment with said cup-shaped support member, and being adapted to secure an umbrella in position when supported by said cup-shaped support member.

6. A device in accordance with claim 1 wherein said harness is adjustable in size to enable said harness to fit various sized persons, wherein said harness has a pair of said shoulder straps, wherein one of said pair of shoulder straps is connected to said plate at two spaced-apart locations so as to form one of said spaced-apart pair of separate loops, and wherein the other of said pair of shoulder straps is connected to said plate at two other spaced-apart locations so as to form the other of said spaced-apart pair of separate loops.

7. A device in accordance with claim 1 wherein said umbrella supporting means further comprises at least one clamp means attached to and extending rearwardly from said plate, said clamp means being disposed above and in vertical alignment with said cup-shaped support member, said clamp means being adapted to secure said tube in the position defined by the pivotal positioning of said cup-shaped support member.

8. A device in accordance with claim 1 wherein:

A. said harness is adjustable in size to enable said harness to fit various sized persons;

B. said harness has a pair of said shoulder straps;

C. one of said pair of shoulder straps is connected to said plate at two spaced-apart locations so as to form one of said spaced-apart pair of separate loops, and the other of said pair of shoulder straps is connected to said plate at two other spaced-apart locations so as to form the other of said spaced-apart pair of separate loops; and D. said umbrella supporting means further comprises at least one clamp means attached to and extending rearwardly from said plate, said clamp means being disposed above and in vertical alignment with said cup-shaped support member, said clamp means being adapted to secure said tube in the position defined by the pivotal positioning of said cup-shaped support member.

9. A device in accordance with claim 8 wherein said plate is in the shape of a rectangle with a top edge, a bottom edge and two side edges, and wherein said brackets and said cup-shaped member are disposed (i) upwardly from said bottom edge by between about ¼ to ½ the total distance from said bottom edge to said top edge, and (ii) equidistantly from said side edges.

10. A device for supporting and maintaining an open umbrella in position above a user of the umbrella and where the umbrella has a handle, said device comprising:

a) a plate sized and adapted to fit against the back of said user;

b) a harness connectable to said plate and adapted when connected to said plate to support said plate against a middle portion of the back of said user, said harness comprising (i) at least one shoulder strap connectable to said plate so as to form a spaced-apart pair of separate loops, whereby when said at least one strap is connected to said plate, one of said loops is disposed and adapted to extend upwardly and downwardly over the left shoulder and laterally around the rib cage area below the left arm of the user, and the other said loop is disposed and adapted to extend upwardly and downwardly over the right shoulder and laterally around the rib cage area below the right arm of the user; (ii) a pair of individual frontal strap members, one of said frontal strap members being affixed to one of said loops, and the other of said frontal strap members being affixed to the other of said loops such that when said at least one strap is connected to said plate and the harness is worn by the user whereby one of said loops extends upwardly and downwardly over the left shoulder and laterally around the rib cage area below the left arm of the user, and the other said loop extends upwardly and downwardly over the right shoulder and laterally around the rib cage area below the right arm of the user, said frontal strap members are disposed and adapted to extend toward each other across the front of the chest of the user, and (iii) connector means for detachably connecting said frontal strap members together across the front of the chest of the user to thereby secure the harness in position on the upper torso of the user; and c) umbrella supporting means adapted to support an umbrella in open position above the user so that the user need not hold said umbrella in either hand, said umbrella supporting means comprising (i) a pair of brackets attached to and extending rearwardly from said plate; (ii) a cup-shaped support member having an open end and a closed end, said cup-shaped support member being adapted to provide support to the handle of the umbrella and being pivotally supported between said pair of brackets such that said cup-shaped support member is rearwardly spaced from said plate with said open end facing upwardly and said closed end facing downwardly whereby said cup-shaped support member can be pivotally tilted to selected forwardly inclined angles of inclination; and (iii) a tube at least a portion of which is sized to fit into said cup-shaped support members said tube being adapted snugly encase at least a substantial portion of the handle of an umbrella when supported by said cup-shaped support member;

said device being further characterized in that said plate is in the shape of a rectangle with a top edge, a bottom edge and two side edges, and in that said brackets and said cup-shaped member are disposed (i) upwardly from said bottom edge by between about ¼ to ½ the total distance from said bottom edge to said top edge, and (ii) equidistantly from said side edges.

11. A device in accordance with claim 10 wherein said harness has a pair of said shoulder straps, wherein one of said pair of shoulder straps is connectable to said plate at two spaced-apart locations so as to form one of said spaced-apart pair of separate loops, and wherein the other of said pair of shoulder straps ids connectable to said plate at two other spaced-apart locations so as to form the other of said spaced-apart pair of separate loops.

12. A device in accordance with claim 11 wherein each of said shoulder straps is equipped with adjusting means for adjusting the size of its respective loop.

13. A device in accordance with claim 10 wherein said umbrella supporting means further comprise at leat one clamp means attached to and extending rearwardly from said plate, said clamp means being disposed above and in vertical alignment with said cup-shaped support member, and being adapted to secure an umbrella in position when supported by said cup-shaped support member.

14. A device in accordance with claim 10 wherein said harness is adjustable in size to enable said harness to fit various sized persons, wherein said harness has a pair of said shoulder straps, and wherein one of said pair of shoulder straps is connectable to said plate at two spaced-apart locations so as to form one of said spaced-apart pair of separate loops, and wherein the other of said pair of shoulder straps is connectable to said plate at two other spaced-apart locations so as to form the other of said spaced-apart pair of separate loops.

15. A device in accordance with claim 10 wherein said umbrella supporting means further comprises at least one clamp means attached to and extending rearwardly from said plate, said clamp means being disposed above and in vertical alignment with said cup-shaped support member, said clamp means being adapted to secure said tube in the position defined by the pivotal positioning of said cup-shaped support member.

* * * * *